US006447190B1

(12) United States Patent
Kwitek

(10) Patent No.: US 6,447,190 B1
(45) Date of Patent: Sep. 10, 2002

(54) VISCOELASTIC GRIP FOR A WRITING IMPLEMENT

(76) Inventor: Benjamin J. Kwitek, 1061 Valley View Dr., Canon City, CO (US) 81212

( * ) Notice: Subject to any disclaimer, the term of this patent is extended or adjusted under 35 U.S.C. 154(b) by 11 days.

(21) Appl. No.: 09/704,556

(22) Filed: Nov. 3, 2000

Related U.S. Application Data

(63) Continuation-in-part of application No. 09/173,445, filed on Oct. 16, 1998.
(60) Provisional application No. 60/163,259, filed on Nov. 3, 1999.

(51) Int. Cl.[7] ..... B43K 23/1122
(52) U.S. Cl. ..... 401/6; 15/443; 16/430
(58) Field of Search ..... 401/6; 15/443; 16/110.1, 430

(56) References Cited

U.S. PATENT DOCUMENTS

| | | | | |
|---|---|---|---|---|
| 584,220 A | | 6/1897 | Gunsaul | |
| 4,785,495 A | | 11/1988 | Dellis | 16/111 R |
| 4,911,569 A | * | 3/1990 | Hashimoto et al. | 401/6 X |
| 4,953,861 A | | 9/1990 | Nakanishi | 273/76 J |
| 4,998,367 A | | 3/1991 | Leibowitz | 42/71.02 |
| 5,000,599 A | | 3/1991 | McCall et al. | 401/6 |
| 5,197,732 A | | 3/1993 | Lanctot | 273/73 R |
| D338,915 S | | 8/1993 | Willat | D19/51 |
| 5,322,290 A | | 6/1994 | Minami | 273/187.5 |
| 5,435,549 A | | 7/1995 | Chen | 273/75 |
| 5,555,584 A | | 9/1996 | Moore, III et al. | 12/142 N |
| 5,653,643 A | | 8/1997 | Falone et al. | 473/300 |

* cited by examiner

*Primary Examiner*—Gregory L. Huson
*Assistant Examiner*—Kathleen J. Prunner
(74) *Attorney, Agent, or Firm*—Welsh & Flaxman LLC

(57) ABSTRACT

A grip adapted for attachment to a writing implement includes a longitudinally extending tubular shell having an inner surface and an outer surface. The grip further includes a viscoelastic hand/finger surface formed about the outer surface of the tubular shell.

5 Claims, 3 Drawing Sheets

VISCOELASTIC GRIP FOR A WRITING IMPLEMENT

CROSS-REFERENCE TO RELATED APPLICATIONS

This U.S. Patent Application is based upon U.S. Provisional Patent Application Serial No. 60/163,259, filed Nov. 3, 1999, and entitled "VISCOELASTIC GRIP FOR A WRITING IMPLEMENT". This U.S. patent application is further a Continuation-In-Part of U.S. patent application Ser. No. 09/173,445, filed Oct. 16, 1998, and entitled "GOLF GRIP", which is currently pending, and incorporated herein by reference.

BACKGROUND OF THE INVENTION

1. Field of the Invention

The invention relates to grips for hand held implements. More particularly, the invention relates to a writing implement grip including a responsive polymer designed to provide individuals with a soft and individually conforming hand and finger surface. While the present grip technology was developed with writing implements in mind, the present grip technology may be readily used with other hand held implements; for example, medical instruments, hand tools, utensils and sporting equipment.

2. Description of the Prior Art

The manner in which an individual grips a writing implement is critical to the comfort of the user as he or she moves the writing implement across a sheet of paper. With this in mind, the designers of writing implements have continually attempted to design writing implements which enhance the comfort for those individuals using their implements.

Many of the techniques employed in prior art writing implements have made great strides in improving the comfort level associated with the continued use of writing implements. However, a need still exists for writing implements which enhance the comfort of individuals using the writing implements on a continual basis. The present invention provides a writing implement grip improving upon those grips disclosed in the prior art.

SUMMARY OF THE INVENTION

It is, therefore, an object of the present invention to provide a grip shaped and dimensioned for use with a writing implement. The grip includes a longitudinally extending tubular shell having an inner surface and an outer surface. The grip also includes a viscoelastic hand/finger surface formed about the outer surface of the tubular shell.

It is also an object of the present invention to provide a grip wherein the tubular shell includes a first end and a second end. The tubular shell further includes an outwardly extending first lip adjacent the first end of the tubular shell and a outwardly extending second lip adjacent the second end of the tubular shell, the first and second lips acting to retain the viscoelastic hand/finger surface in position on the tubular shell.

It is another object of the present invention to provide a grip wherein the first lip extends about the circumference of the tubular shell adjacent the first end of the tubular shell and the second lip extends about the circumference of the tubular shell adjacent the second end of the tubular shell.

It is a further object of the present invention to provide a grip wherein the viscoelastic hand/finger surface is a viscoelastic solid-phase polymer material.

It is also an object of the present invention to provide a grip wherein the viscoelastic solid-phase polymer material is a thermoplastic elastomer.

It is still another object of the present invention to provide a grip wherein the viscoelastic hand/finger surface is a viscous liquid material contained within an elastomeric bag.

It is yet a further object of the present invention to provide a grip wherein the viscoelastic liquid material is a silicone gel or silicone oil.

It is also an object of the present invention to provide a grip wherein the grip is adapted for selective attachment to the writing implement.

It is another object of the present invention to provide a grip wherein the grip is integrally formed with the writing implement.

It is also an object of the present invention to provide a writing implement including a grip as described above.

Other objects and advantages of the present invention will become apparent from the following detailed description when viewed in conjunction with the accompanying drawings, which set forth certain embodiments of the invention.

DESCRIPTION OF THE PREFERRED EMBODIMENTS

The detailed embodiments of the present invention are disclosed herein. It should be understood, however, that the disclosed embodiments are merely exemplary of the invention, which may be embodied in various forms. Therefore, the details disclosed herein are not to be interpreted as limited, but merely as the basis for the claims and as a basis for teaching one skilled in the art how to make and/or use the invention.

Figure 1:
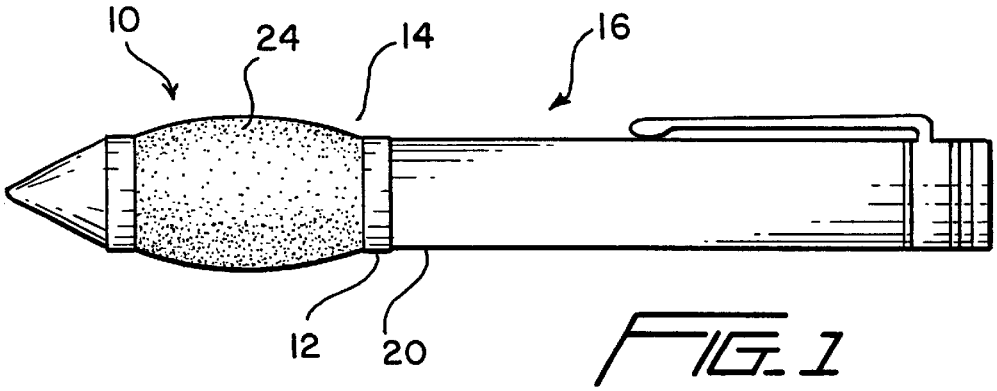
FIG. 1 is a side view of a writing implement with the present grip mounted thereon.
Figure 4:
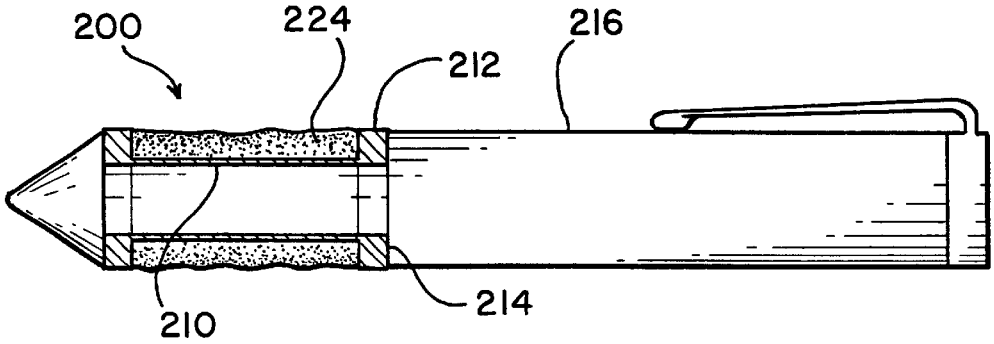
FIG. 4 is a cross section of a writing implement with the present grip representing yet another embodiment of the present invention.
Figure 2:
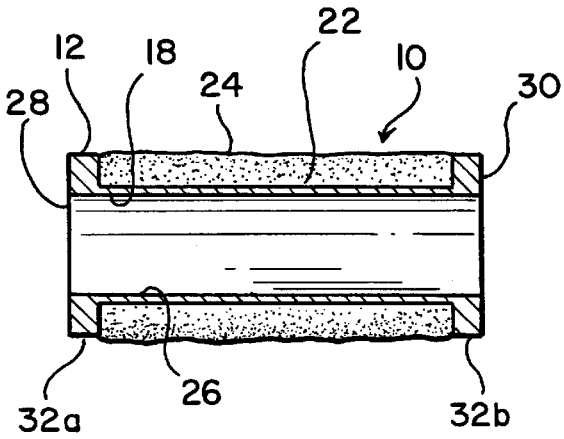
FIG. 2 is a cross-sectional view of a grip according to a preferred embodiment of the present invention.
Figure 3:
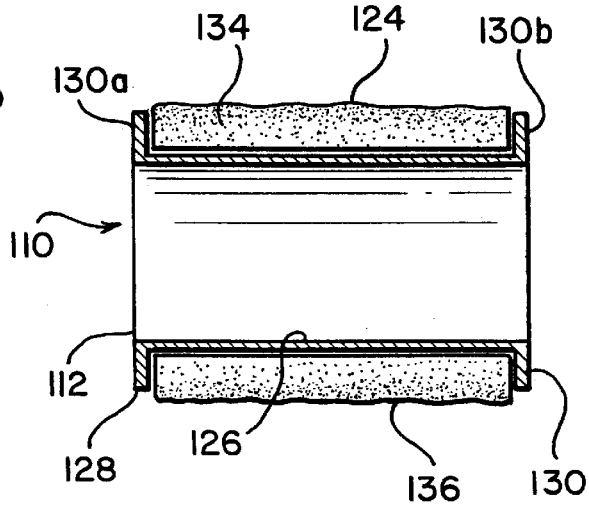
FIG. 3 is a cross-sectional view of a grip according to a further preferred embodiment of the present invention.

With reference to FIGS. 1 through 5, a writing implement grip is disclosed. The grip is designed with a responsive and relatively viscoelastic hand/finger surface. The viscoelastic hand/finger surface provides individuals with a soft and individually conforming gripping surface. For example, and in accordance with a preferred embodiment of the present invention, the conformable, viscoelastic hand/finger surface is a responsive, solid-phase polymer material (FIGS. 1 and 2) or a gelatinous material interposed within a more resilient material to contain the gelatinous material (FIG. 3).

The hand/finger surface of the present grip is an ultra-soft material. This endows the grip with an inherent tactile feel. The grip, as described herein, provides a tacky surface, essential and beneficial for gripping. As those skilled in the art will readily appreciate, the tack level may be readily adjusted with chemical and/or mechanical processing modification. The ultra-soft hand/finger surface can be measured in terms of hardness by the Shore A Durometer Test. The present grips have durometers in this scale between approximately 2 and 35, and more preferably 25 or less.

In accordance with a preferred embodiment of the present grip, and with reference to FIGS. 1 and 2, the grip 10 is shaped and dimensioned to fit about the gripping portion 14 of the main body 20 of a writing implement 16 so as to be releasably secured to the main body 20. The grip 10 includes a shell 12. Because of the shape and fit of the grip 10, the shell 12 includes an inner surface 18 shaped and dimensioned to fit about and abut the main body 20 of the writing implement 16 at a position in line with the grip portion 14 thereof.

It is contemplated that the lower half, or grip portion 14, of the writing implement 16 may be formed with a recess or ridges shaped and dimensioned to engage the grip 10 as it is slipped onto the writing implement 16. In this way, the attached grip 10 will be substantially flush with the overall shape and dimensions of the main body 20 of the writing implement 16.

The outer surface 22 of the shell 12 is shaped and dimensioned to receive the viscoelastic hand/finger surface 24. The shell 12 includes a central section 26 about which the viscoelastic hand/finger surface 24 is positioned. The proximal end 28 and distal end 30 of the shell 12 are respectively provided with lips 32*a*, 32*b* circumferentially extending about the shell 12. The lips 32*a*, 32*b* are shaped and dimensioned to retain the viscoelastic hand/finger surface 24 about the central section 26 of the shell 12.

The shell 12 may maintain a constant diameter as it extends from the proximal end 28 to the distal end 30. The shape is determined based upon the writing implement for which the grip 10 is designed and may be readily varied without departing from the spirit of the present invention for adaptation to various writing implements. This allows the shell 12 to conform to the shape of conventional writing implements.

The shell 12 may be constructed from a variety of elastomers, such as, thermoplastics or thermosets including rubber or synthetic rubber-like materials. In accordance with a preferred embodiment of the present invention, the shell preferably has a Shore A hardness of 20–55. This firmness is necessary to maintain the shape of the grip. It also prevents damage from chemicals and oils, including those produced by human hands. However, other materials may be employed without departing from the spirit of the present invention.

In accordance with the embodiment disclosed in FIGS. 1 and 2, the viscoelastic hand/finger surface 24 is preferably a viscoelastic solid-phase polymer material. The viscoelastic solid-phase polymer material is preferably a styrenic thermoplastic elastomer containing, for example, KRATON, which is manufactured by Shell Chemical Company.

The viscoelastic hand/finger surface 24 is positioned about the shell 12, and between the proximal and distal lips 32*a*, 32*b*. The viscoelastic hand/finger surface 24 is preferably adhered to the central section 26 of the shell 12 by over-molding, co-molding or two-part molding. With related materials over-molding will create a chemical bond, in essence forging one piece containing assimilated parts. This produces a dual durometer grip. This grip would have the advantage of being soft and conformable while being durable and cost effective. It is also contemplated that the viscoelastic hand/finger surface 24 may be adhered to the central section 26 of the shell 12 with an adhesive. As those of ordinary skill in the art will certainly appreciate, other methods for securing the hand/finger surface 24 to the shell 12 may be employed without departing from the spirit of present invention. Where the viscoelastic hand/finger surface 24 is formed from a responsive, and relatively viscoelastic solid-phase polymer material, the outer surface 22 of the viscoelastic hand/finger surface 24 is formed from the same viscoelastic material as the remainder of the hand/finger surface.

An alternate embodiment of the present invention is disclosed in FIG. 3. The alternate embodiment is substantially similar to the embodiment described above with reference to FIGS. 1 and 2, but replaces the viscoelastic solid-phase polymer construction with a viscous liquid material contained in an elastomeric bag.

Specifically, the grip 110 includes a shell 112 shaped and dimensioned to fit about the grip portion 14 of a writing implement 16. As with the prior embodiment, the shell 112 includes a central section 126 about which the soft viscoelastic hand/finger surface 124 is positioned. The proximal and distal ends 128, 130 of the shell 112 are respectively provided with lips 130*a*, 130*b*. The lips 130*a*, 130*b* are shaped and dimensioned to retain the soft polymer material forming the hand/finger surface 124 about the central section 126 of the shell 112.

In accordance with the embodiment disclosed in FIG. 3, the viscoelastic hand/finger surface 124 is a viscous liquid material 134 contained in an elastomeric bag 136. The viscous liquid 134 is preferably a silicone gel or oil and the elastomeric bag is preferably a silicone sheet or a thermoplastic elastomer. While preferred materials are disclosed above, other materials exhibiting similar properties may be used without departing from the spirit of the present invention.

The viscoelastic hand/finger surface 124 is preferably adhered to the central section 126 of the shell 112 with an adhesive. The attachment could also be accomplished by compressing both ends of the elastomeric bag 136 at the proximal and distal lips 130*a*, 130*b* with a chamber and gasket system. As those of ordinary skill in the art will certainly appreciate, other methods for securing the viscoelastic hand/finger surface to the shell may be employed without departing from the spirit of present invention.

The grips 10, 110 described above are designed for selective attachment to an existing writing implement in a manner allowing an individual to readily remove and replace the grips, if necessary. However, and as those skilled in the art will readily appreciate, the underlying concepts of the present grip may be applied in manufacturing an integrally formed writing implement/grip 200. Specifically, and with reference to FIG. 4, the shell 212 of the grip 210 is integrally formed as part of the grip portion 214 of the writing implement 216 and the viscoelastic hand/finger surface 224 is coupled directly thereto. Other manufacturing techniques in accordance with the spirit of the present invention are certainly possible and considered to be well within the scope of the present invention.

In accordance with the preferred embodiments of the present invention, the soft polymer material forming the hand/finger surface is approximately 0.02 to 0.50 inches thick and the elastomeric shell is preferably less than 0.5 inches thick. In this way, the present grip substantially conforms to ergonomically desirable writing implement dimensions.

Figure 5:
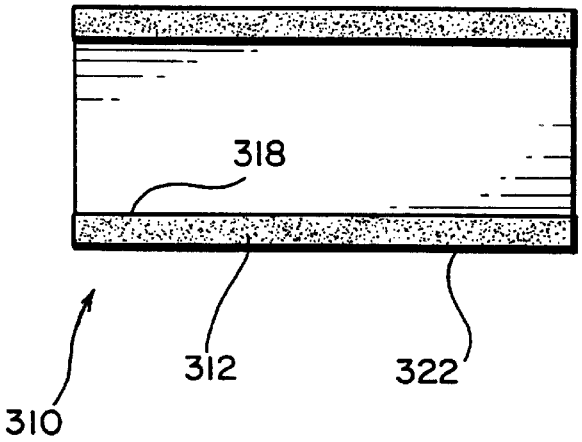
FIG. 5 is a cross-sectional view of a grip according to a further preferred embodiment of the present invention.

With reference to FIG. 5, an alternate embodiment for a responsive grip is also contemplated. Specifically, a one piece grip 310 manufactured exclusively from a viscoelastic solid-phase polymer material is disclosed. The grip 310 includes a longitudinally extending tubular shell 312 having an inner surface 318 shaped and dimensioned for attachment to the grip portion 14 of a writing implement 16 and an outer surface 322 shaped and dimensioned for gripping by an individual. The shell 312 is preferably manufactured from a silicone, thermoset elastomer containing, for example, SILASTIC, manufactured by Corning STI, although other materials may be used without departing from the spirit of the present invention. As with the shell discussed above with reference to FIGS. 1–4, the tubular shell shown 310 in FIG. 5 is shaped and dimensioned for use as a gripping surface on a writing implement 16.

It should be appreciated that the elastomer containing, for example, KRATON or liquid silicones (such as, SILASTIC), may be altered via chemical and manufacturing processes. This alteration would likely include the softening of the thermoplastic elastomer. Also other treatments may be used without departing from the spirit of the present invention. The elastomer may also be modified to enhance its performance characteristics. For example, ultra-violet protection and/or fillers, such as Kevlar (an aramid fiber manufactured by DuPont), may be added to enhance the performance of the elastomer.

The provision of a responsive viscoelastic polymer finger surface in all three embodiments, provides users with soft and individually conforming grips. In this way, the grips are designed to enhance the tactile feel of the instrument. This improves the user's ability to work. The soft viscoelastic surface also reduces finger and hand fatigue. The structure of the present invention is also easy to manufacture, either through the use of extrusion or injection molding. It is further contemplated that other manufacturing steps may be involved when the viscous liquid grip is utilized.

The practicality and durability of the present grips are also noteworthy. The inner shell on the grip provides a rigid and long-lasting shape or housing. The shell's strength is maintained even with extended use. The soft outer surface is protected and partially encased by this shell. Unlike foam and other materials, liquids will not adversely affect the grip. Its improved performance is observed with regard to finger oil absorption. The two part design prevents excessive absorption. This greatly reduces the degradation and swelling of the grip with use. The two part grip holds precise its exacting dimensions. The firm and precisely designed shell also makes installation of the grip easier. It will not catch and wrinkle as it is assembled like a soft one-piece rubber grip would.

The present grips also provide greater shock absorption and vibration dampening. Clearly, with regard to various sports implements and other handles, this feature is desirable and helpful to the user. The grips described above provide much more shock absorption than other grips on the market.

The ergonomic emphasis of this design is positive. Its use may help lower the rate of finger/hand injuries caused by excessive pressure and rigid surfaces.

As previously mentioned the invention relates generally to conformable grips useful in hand gripped items. With this in mind, an alternate embodiment of the present grip for use in conjunction with a golf grip is disclosed in FIGS. 6 to 8. The golf grip 210, 310 is designed with a responsive and relatively viscoelastic hand surface 212, 312. The viscoelastic hand surface 212, 312 provides golfers with a soft and individually conforming hand surface. For example, the viscoelastic hand surface 212, 312 may be a responsive and relatively viscoelastic solid-phase polymer material (FIGS. 6 and 7) or a gelatinous material interposed within a more resilient material to contain the gelatinous material (FIG. 8).

The hand surface of the present grip is an ultra-soft material. This also endows the product with an inherent tactile feel. The grip, as described herein, provides a tacky surface, essential and beneficial for gripping. The ultra-soft hand surface can be measured in terms of hardness by the Shore A Durometer Test. The present grips have durometers in this scale between approximately 2 and 40.

Figure 7:
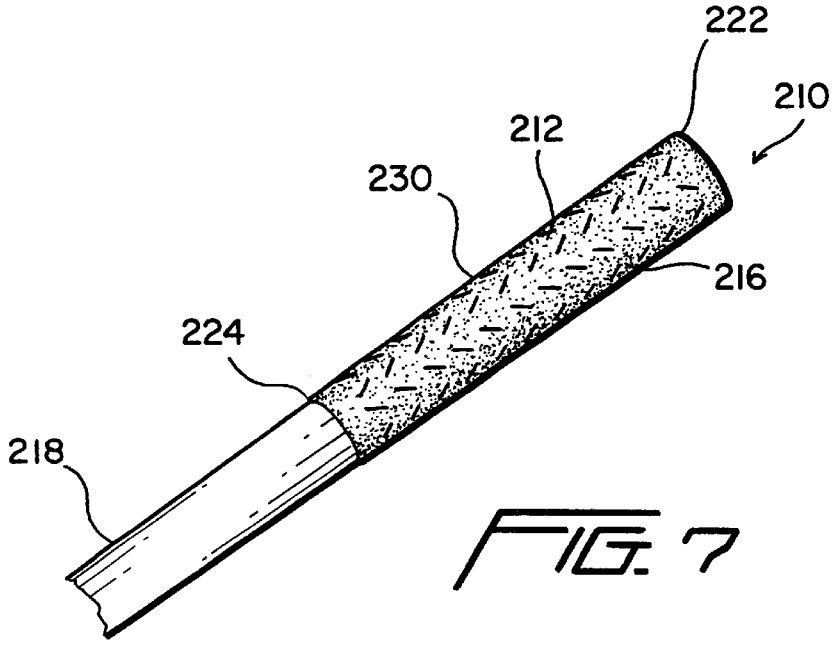
FIG. 7 is a perspective view of the present golf grip.
Figure 6:
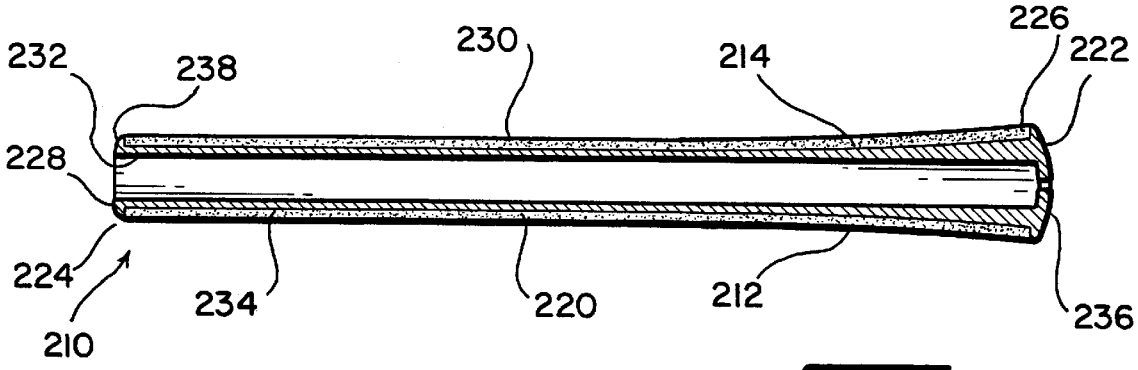
FIG. 6 is a cross-sectional view of the present golf grip.
Figure 8:
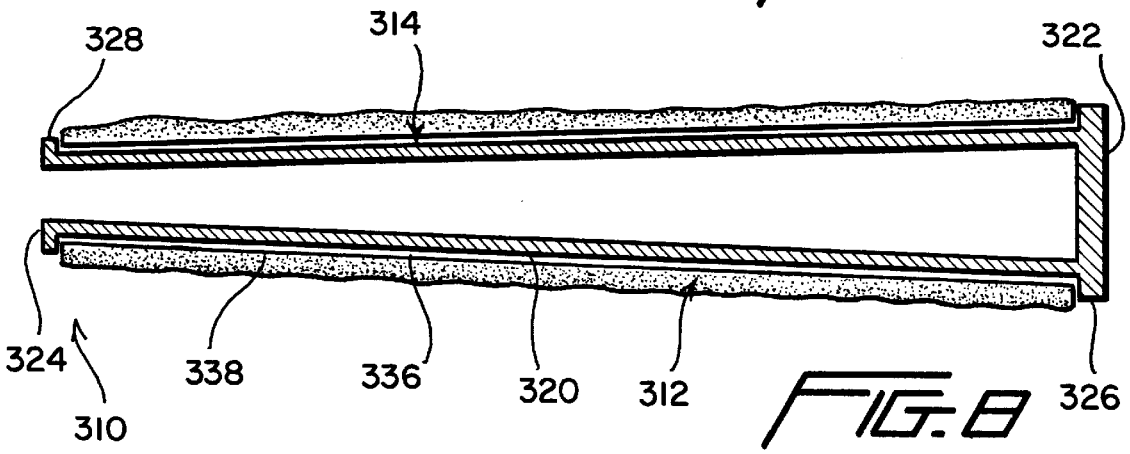
FIG. 8 is a cross-sectional view of an alternate embodiment in accordance with the present invention.

In accordance with a preferred embodiment of the present golf grip 210, and with reference to FIGS. 6 and 7, the golf grip 210 includes a shell 214 shaped and dimensioned to fit about the proximal end 216 of a golf club shaft 218. As such, the shell 214 includes an inner surface 232 shaped and dimensioned to fit about the golf club shaft. The outer surface 234 of the shell 214 is shaped and dimensioned to receive the viscoelastic hand surface 212 in a manner that will be discussed in greater detail below.

As with most golf grips, the present golf grip 210, and the shell 214, are tapered as they extend from the closed proximal end 236 to the open distal end 238. This allows the shell 214 to conform to the shape of conventional golf club shafts 218.

The shell 214 may be constructed from a variety of soft elastomers, such as, rubber or synthetic rubber-like materials. However, other materials may be employed without departing from the spirit of the present invention.

The shell 214 includes a central section 220 about which the viscoelastic hand surface 212 is positioned. The proximal end 222 and distal end 224 of the shell 214 are respectively provided with lips 226, 228 circumferentially extending about the shell 214. The lips 226, 228 are shaped and dimensioned to retain the viscoelastic hand surface 212 about the central section 220 of the shell 214.

In accordance with the embodiment disclosed in FIGS. 6 and 7, the viscoelastic hand surface 212 is preferably a viscoelastic solid-phase polymer material. The viscoelastic solid-phase polymer material is preferably a styrenic thermoplastic elastomer containing, for example, KRATON, which is manufactured by Shell Chemical Company.

The viscoelastic hand surface 212 is positioned about the shell 214, and between the proximal and distal lips 226, 228. The viscoelastic hand surface 212 is preferably adhered to the central section 220 of the shell 214 with an adhesive. It is also contemplated that the hand surface 212 may be adhered to the central section 220 of the shell 214 by over molding. With related materials over molding would create a chemical bond, in essence forging one piece containing assimilated parts. As those of ordinary skill in the art will certainly appreciate, other methods for securing the hand surface 212 to the shell 214 may be employed without departing from the spirit of present invention. Where the viscoelastic hand surface 212 is formed from a responsive, and relatively viscoelastic solid-phase polymer material, the outer surface 230 of the viscoelastic hand surface 212 is formed from the same viscoelastic material as the remainder of the hand surface 212.

An alternate embodiment of the present invention is disclosed in FIG. 8. The alternate embodiment is substantially similar to the embodiment described above with reference to FIGS. 6 and 7, but replaces the viscoelastic solid-phase polymer construction with a viscous liquid material contained in an elastomeric bag.

Specifically, the golf grip 310 includes a shell 314 shaped and dimensioned to fit about the proximal end of a golf club shaft. As with the prior embodiment, the shell 314 includes a central section 320 about which the soft viscoelastic hand surface 312 is positioned. The proximal and distal ends 322, 324 of the shell 314 are respectively provided with lips 326, 328. The lips 326, 328 are shaped and dimensioned to retain the soft polymer material forming the hand surface 312 about the central section 320 of the shell 314.

In accordance with the embodiment disclosed in FIG. 8, the viscoelastic hand surface 312 is a viscous liquid material 336 contained in an elastomeric bag 338. The viscous liquid 336 is preferably a silicone gel or oil and the elastomeric bag 338 is preferably a silicone sheet or a thermoplastic elastomer. While preferred materials are disclosed above, other materials exhibiting similar properties may be used without departing from the spirit of the present invention.

The viscoelastic hand surface 312 is preferably adhered to the central section 320 of the shell 314 with an adhesive. The attachment could also be accomplished by compressing both ends of the elastomeric bag 338 at the proximal and distal lips 326, 328 with a chamber and gasket system. As those of ordinary skill in the art will certainly appreciate, other methods for securing the viscoelastic hand surface 312 to the shell 314 may be employed without departing from the spirit of present invention.

The present golf grip 210, 310 is designed such that it may be placed about the proximal end of the golf club shaft in much the same manner that conventional golf grips are placed about the proximal end of a golf club shaft. As such, the present golf grip 210, 310 may be used as a replacement grip for worn grips or grips placed upon a golf club during the manufacture of the golf club.

In accordance with the preferred embodiments of the present invention, the soft polymer material forming the hand surface 212, 312 is approximately 1/16"–1/4" thick and the elastomeric shell 214, 314 may be less than 1/8" thick, but up to 1/4" thick. In this way, the present grip 210, 310 has substantially the same dimensions as conventional golf grips.

Figure 9:
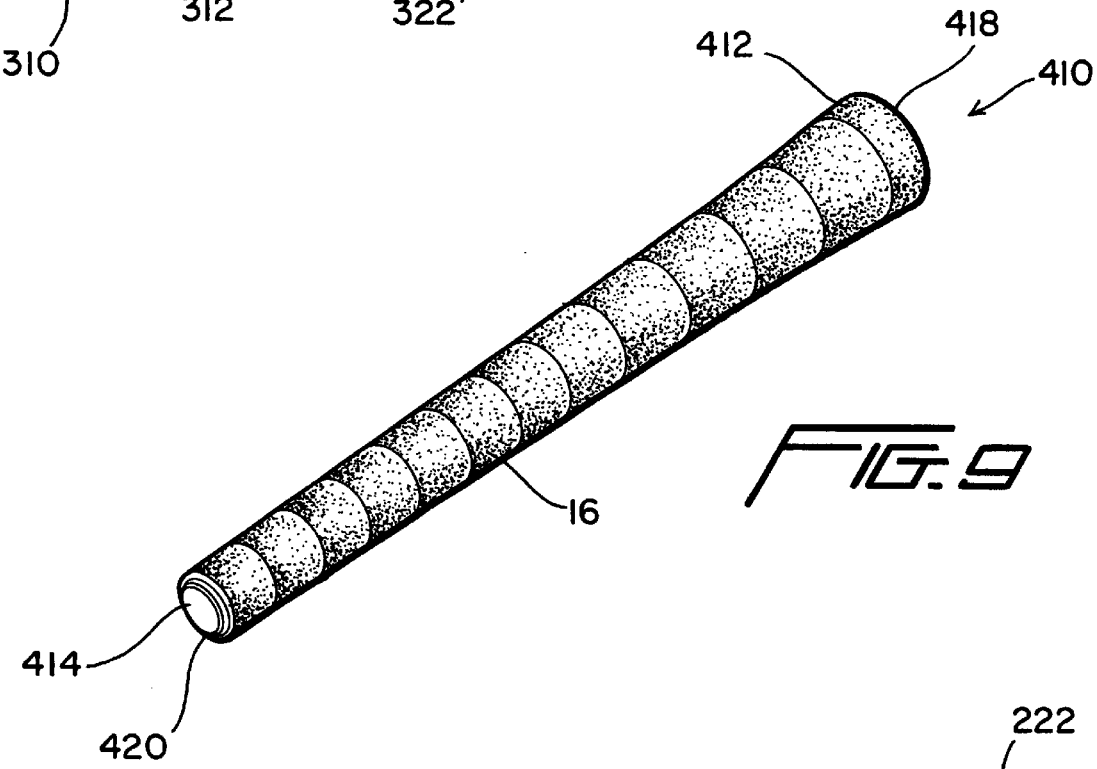
FIG. 9 is a perspective view of a further embodiment in accordance with the present invention.
Figure 10:
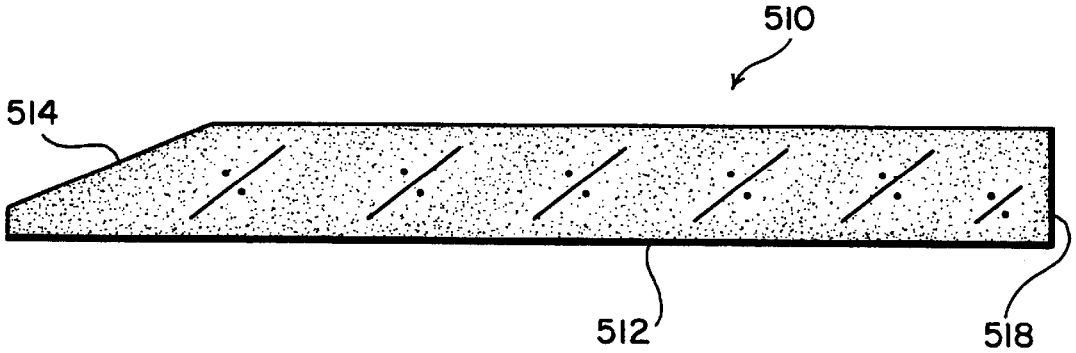
FIG. 10 is a top view of still another embodiment in accordance with the present invention.
Figure 11:
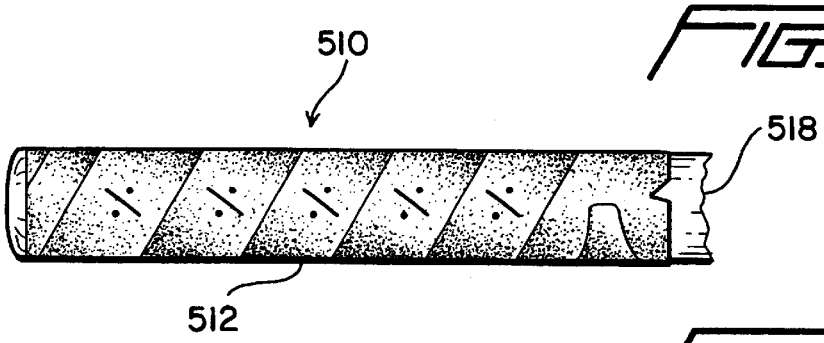
FIG. 11 is a perspective view of the embodiment disclosed in FIG. 6 secured to a golf shaft.

With reference to FIGS. 9 through 11, alternate embodiments for a responsive grip are also contemplated. Specifically, FIG. 9 discloses a one piece grip 410 manufactured exclusively from a viscoelastic solid-phase polymer material. The grip 410 includes a longitudinally extending tubular shell 412 having an inner surface 414 shaped and dimensioned for attachment to a golf club shaft and an outer surface 416 shaped and dimensioned for gripping by an individual. The shell 412 is preferably manufactured from a styrenic thermoplastic elastomer containing, for example, KRATON, manufactured by Shell Chemical Company, although other materials may be used without departing from the spirit of the present invention.

As with the shell discussed above with reference to FIGS. 6 to 8, the tubular shell 412 shown in FIG. 9 is shaped and dimensioned for use as a golf club grip. With this in mind, the grip is slightly tapered from its closed first end 418 to its open second end 420.

The embodiment disclosed in FIGS. 10 and 11 is a wrap 510 for application to grips. The wrap is a longitudinally extending strip 512 of a viscoelastic solid-phase polymer material having a first end 514 and a second end 516, wherein the first end 514 is cut at an oblique angle to facilitate attachment of the strip 512 to the handle 518 of a sports, or other, implement. The strip 512 is of a length sufficient to be wrapped about the handle 518 and to act as a grip for the implement. The wrap 510 is preferably manufactured from a thermoplastic elastomer, for example, KRATON, manufactured by Shell Chemical, although other materials may be used without departing from the spirit of the present invention. The wrap is, again, composed of the ultra-soft material, which provides unprecedented benefits and advantages to the user.

As shown in Figure —, the wrap 510 is secured to the handle 518 of a sports implement, or other implement, by simply encircling the handle in a conventional manner. Additionally, all-purpose adhesive tape or glue may be placed between the handle 518 and the wrap 510 to ensure the secure attachment of the wrap 510 to the handle 518.

It should be appreciated that the styrenic thermoplastic elastomer containing, for example, KRATON, may be altered via chemical and manufacturing processes. This alteration would likely include the softening of the thermoplastic elastomer. Also other treatments may be used without departing from the spirit of the present invention.

The provision of a responsive viscoelastic polymer hand surface provides golfers with a soft and individually conforming hand surface. In this way, the present grips are designed to enhance the feel of the golf club, and, thereby, improve the golfer's ability to strike a golf ball. A soft grip surface prompts the golfer to use a softer touch in putting and it helps to avoid excessive squeezing on other clubs. The soft viscoelastic hand surface also reduces hand to fatigue associated with gripping a hard hand surface. In addition, the use of an elastomeric shell with a responsive viscoelastic polymer material encased therein makes the present golf grip easy to manufacture and place upon the proximal end of a golf club shaft for use by a golfer.

The present grips also provide greater shock absorption and vibration dampening. Clearly, with regard to various sports implements and other handles, this feature is desirable and helpful to the user. The grips described above provide much more shock absorption than other grips on the market.

While the preferred embodiments have been shown and described, it will be understood that there is no intent to limit the invention by such disclosure, but rather, is intended to cover all modifications and alternate constructions falling within the spirit and scope of the invention.

What is claimed is:

1. A writing implement, comprising:

a main body having a gripping portion;

a grip shaped and dimensioned to fit about the gripping portion of the main body so as to be releasably secured to the main body;

the grip including a longitudinally extending, tubular shell having a hardness sufficient to maintain the shape of the grip, the shell has an inner surface abuting with the main body and an outer surface, and a viscoelastic hand/finger surface positioned about the outer surface of the tubular shell; the shell further including proximal and distal lips retaining the viscoelastic hand/finger surface positioned in a central section of the tubular shell.

2. The writing implement according to claim 1, wherein the viscoelastic hand/finger surface is a viscoelastic solid-phase polymer material.

3. The writing implement according to claim 2, wherein the viscoelastic solid-phase polymer material is a themoplastic elastomer.

4. The writing implement according to claim 1, wherein the viscoelastic hand/finger surface is a viscous liquid material contained within an elastomeric bag.

5. The writing implement according to claim 4, wherein the viscous liquid material is a silicone gel or silicone oil.

* * * * *

US006447190C1

(12) INTER PARTES REEXAMINATION CERTIFICATE (497th)

United States Patent
Kwitek

(10) Number: US 6,447,190 C1
(45) Certificate Issued: Dec. 20, 2012

(54) VISCOELASTIC GRIP FOR A WRITING IMPLEMENT

(76) Inventor: Benjamin J. Kwitek, Canon City, CO (US)

Reexamination Request:
No. 95/000,399, Nov. 17, 2008

Reexamination Certificate for:

| | |
|---|---|
| Patent No.: | **6,447,190** |
| Issued: | **Sep. 10, 2002** |
| Appl. No.: | **09/704,556** |
| Filed: | **Nov. 3, 2000** |

Related U.S. Application Data

(63) Continuation-in-part of application No. 09/173,445, filed on Oct. 16, 1998, now abandoned.

(60) Provisional application No. 60/163,259, filed on Nov. 3, 1999.

(51) Int. Cl.
*B43K 23/008* (2006.01)

(52) U.S. Cl. ..... 401/6; 15/443; 16/430

(58) Field of Classification Search ..... None
See application file for complete search history.

(56) References Cited

To view the complete listing of prior art documents cited during the proceeding for Reexamination Control Number 95/000,399, please refer to the USPTO's public Patent Application Information Retrieval (PAIR) system under the Display References tab.

*Primary Examiner* — Jeanne M Clark

(57) ABSTRACT

A grip adapted for attachment to a writing implement includes a longitudinally extending tubular shell having an inner surface and an outer surface. The grip further includes a viscoelastic hand/finger surface formed about the outer surface of the tubular shell.

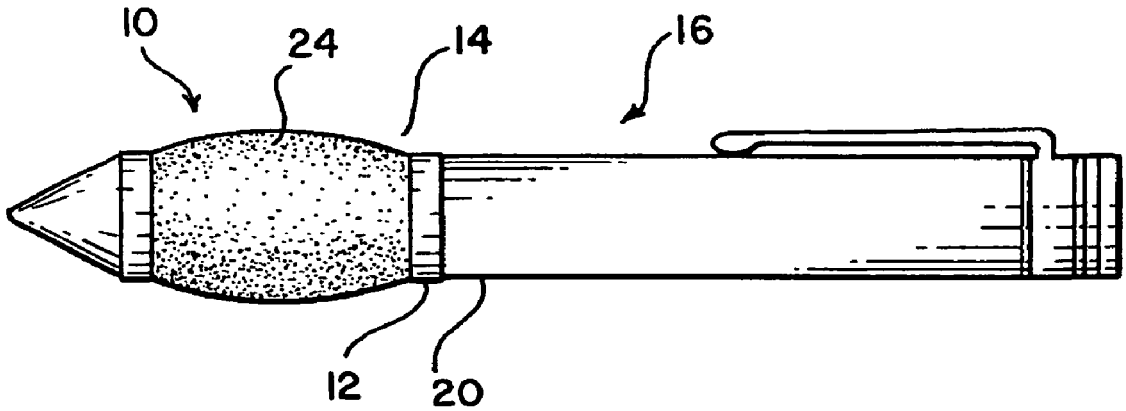

INTER PARTES REEXAMINATION CERTIFICATE ISSUED UNDER 35 U.S.C. 316

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1-5 are cancelled.

New claims 6-10 are added and determined to be patentable.

*6. A writing implement, comprising:*

*a main body having a gripping portion having a recess;*

*a grip shaped and dimensioned to fit about the gripping portion of the main body and within the recess of the gripping portion so as to be releasably secured to the main body and flush with an overall shape of the main body;*

*the grip including a longitudinally extending, tubular shell having a Shore A hardness sufficient to maintain the shape of the grip, the shell has an inner surface abuting with the main body and an outer surface, and a viscoelastic hand/finger surface positioned about the outer surface of the tubular shell, the viscoelastic hand/finger surface having a Shore A Durometer hardness of 2 to 35;*

*the shell further including proximal and distal lips retaining the viscoelastic hand/finger surface positioned in a central section of the tubular shell.*

*7. The writing implement according to claim 6, wherein the viscoelastic hand/finger surface is a viscoelastic solid-phase polymer material.*

*8. The writing implement according to claim 7, wherein the viscoelastic solid-phase polymer material is a themoplastic elastomer.*

*9. The writing implement according to claim 6 wherein the viscoelastic hand/finger surface is a viscous liquid material contained within an elastomeric bag.*

*10. The writing implement according to claim 9, wherein the viscous liquid material is a silicone gel or silicone oil.*

* * * * *